US011688375B2

(12) United States Patent
Miki et al.

(10) Patent No.: US 11,688,375 B2
(45) Date of Patent: Jun. 27, 2023

(54) MUSICAL INSTRUMENT CONTROLLER, ELECTRONIC MUSICAL INSTRUMENT SYSTEM, AND CONTROL METHOD THEREOF

(71) Applicant: Roland Corporation, Shizuoka (JP)

(72) Inventors: Jun-ichi Miki, Shizuoka (JP); Akihiro Takeda, Shizuoka (JP); Hiroyuki Yokoyama, Shizuoka (JP)

(73) Assignee: Roland Corporation, Shizuoka (JP)

( * ) Notice: Subject to any disclaimer, the term of this patent is extended or adjusted under 35 U.S.C. 154(b) by 427 days.

(21) Appl. No.: 17/049,964

(22) PCT Filed: Jul. 5, 2018

(86) PCT No.: PCT/JP2018/025602
§ 371 (c)(1),
(2) Date: Oct. 23, 2020

(87) PCT Pub. No.: WO2019/207813
PCT Pub. Date: Oct. 31, 2019

(65) Prior Publication Data

US 2021/0241737 A1 Aug. 5, 2021

(30) Foreign Application Priority Data

Apr. 25, 2018 (JP) ..... JP2018-084489

(51) Int. Cl.
*G10H 1/053* (2006.01)
*G10H 1/00* (2006.01)

(52) U.S. Cl.
CPC ..... *G10H 1/053* (2013.01); *G10H 1/0008* (2013.01); *G10H 2210/325* (2013.01);
(Continued)

(58) Field of Classification Search
CPC ..... G10H 1/053; G10H 1/0008; G10H 2210/325; G10H 2220/201; G10H 2220/395; G10H 2220/401
(Continued)

(56) References Cited

U.S. PATENT DOCUMENTS 5,119,709 A * 6/1992 Suzuki ..... G10H 1/0558 84/600
5,136,915 A * 8/1992 Shibukawa ..... G10C 3/20 84/626
(Continued)

FOREIGN PATENT DOCUMENTS

CN 114974185 A * 8/2022
EP 3039671 7/2016
(Continued)

OTHER PUBLICATIONS

Heinrichs et al., "A Hybrid Keyboard-Guiatr INterface using Capacitive Touch Sensing and Physical Modeling", Jan. 1, 2012, https://qmro.qmul.ac.uk/xmlui/bitstream/handle/123456789/4241/HEINRICHSHybridKeyboard-guitar2010.pdf?sequence=2 (Year: 2012).*
(Continued)

*Primary Examiner* — Christina M Schreiber
(74) *Attorney, Agent, or Firm* — JCIPRNET

(57) ABSTRACT

Provided is a musical instrument controller capable of accurately controlling a musical sound parameter. This musical instrument controller includes: a reception means for receiving, from a musical performance device, a sound emission start signal transmitted on the basis of a musical performance operation; a sensor for detecting an amount of displacement from a reference position; and a control means for generating a control signal on the basis of the amount of displacement from the reference position and transmitting the control signal to a sound generation device. The control
(Continued)

means sets the reference position on the basis of the sound emission start signal received from the musical performance device.

17 Claims, 15 Drawing Sheets

(52) U.S. Cl.
CPC . *G10H 2220/201* (2013.01); *G10H 2220/395* (2013.01); *G10H 2220/401* (2013.01)

(58) Field of Classification Search
USPC ..... 84/609
See application file for complete search history.

(56) References Cited

U.S. PATENT DOCUMENTS

| | | | | |
|---|---|---|---|---|
| 5,489,922 | A * | 2/1996 | Zloof | G06F 3/0362 345/157 |
| 5,619,005 | A * | 4/1997 | Shibukawa | G10H 1/053 84/658 |
| 5,920,024 | A * | 7/1999 | Moore | G10H 1/00 356/28 |
| 5,949,012 | A * | 9/1999 | Ishii | G10H 1/0008 84/626 |
| 7,297,862 | B2 * | 11/2007 | Nishitani | G10H 1/00 84/723 |
| 8,609,972 | B2 * | 12/2013 | Harada | G10H 1/0008 84/626 |
| 10,222,194 | B2 * | 3/2019 | Sakurai | G01B 7/14 |
| 2006/0276919 | A1 * | 12/2006 | Shirai | G10H 1/40 |
| 2011/0303076 | A1 * | 12/2011 | Harada | G10H 1/14 84/723 |
| 2013/0180385 | A1 * | 7/2013 | Hamilton | G10H 1/368 84/603 |
| 2016/0210950 | A1 * | 7/2016 | McPherson | G10H 1/34 |
| 2021/0241737 | A1 * | 8/2021 | Miki | G10H 1/0008 |
| 2021/0358462 | A1 * | 11/2021 | Kajihara | G10G 3/04 |
| 2022/0293073 | A1 * | 9/2022 | Kim | G10H 1/053 |
| 2022/0375441 | A1 * | 11/2022 | Terao | G10H 1/348 |

FOREIGN PATENT DOCUMENTS

| | | | | |
|---|---|---|---|---|
| EP | 3039671 | B1 * | 10/2018 | G06F 3/03547 |
| JP | H03288897 | | 12/1991 | |
| JP | H04100097 | | 4/1992 | |
| JP | 3646599 | B2 * | 5/2005 | A63B 71/0686 |
| JP | 2006134066 | | 5/2006 | |
| JP | 2006293210 | | 10/2006 | |
| JP | 2007041770 | | 2/2007 | |
| JP | 2007256412 | | 10/2007 | |
| JP | 2008122644 | | 5/2008 | |
| JP | 2011123248 | | 6/2011 | |
| JP | 2012237866 | | 12/2012 | |
| JP | 2014178482 | | 9/2014 | |
| JP | 2017168060 | | 9/2017 | |
| WO | WO-02067242 | A1 * | 8/2002 | G10H 1/34 |
| WO | WO-2020100671 | A1 * | 5/2020 | A61B 5/0022 |

OTHER PUBLICATIONS

"International Search Report (Form PCT/ISA/210) "of PCT/JP2018/025602, dated Sep. 4, 2018, with English translation thereof, pp. 1-3.

Christian Heinrichs et al., "A hybrid keyboard-guitar interface using capacitive touch sensing and physical modeling", available at http://qmro.qmul.ac.uk/xmlui/handle/123456789/4241/2/HEINRICHSHybridKeyboard-guitar2010.pdf, Jan. 1, 2012, pp. 1-8.

Andrew McPherson, "TouchKeys: Capacitive Multi-Touch Sensing on a Physical Keyboard", 12th New Interfaces for Musical Expression, May 21, 2012, pp. 1-4.

"Search Report of Europe Counterpart Application", dated Dec. 21, 2021, p. 1-p. 11.

* cited by examiner

MUSICAL INSTRUMENT CONTROLLER, ELECTRONIC MUSICAL INSTRUMENT SYSTEM, AND CONTROL METHOD THEREOF

CROSS-REFERENCE TO RELATED APPLICATION

This application is a 371 application of the International PCT application serial no. PCT/JP2018/025602, filed on Jul. 5, 2018, which claims the priority benefits of Japan Patent Application No. 2018-084489, filed on Apr. 25, 2018. The entirety of each of the above-mentioned patent applications is hereby incorporated by reference herein and made a part of this specification.

TECHNICAL FIELD

The present disclosure relates to control of an electronic musical instrument.

BACKGROUND ART

In the field of electronic musical instruments, a mechanism for allowing a player to adjust musical sound parameters such as pitch bend and expression is widely used. For example, musical sound parameters can be changed while carrying out performance using an operator such as a wheel or a lever which is provided in a housing.

On the other hand, when the wheel or the lever is operated while carrying out performance, there is a problem in that one hand of a player is occupied. This problem is particularly remarkable in live performance or the like. With this background, a musical instrument controller which can facilitate an operation more easily has been studied.

As a technique associated therewith, Patent Literature 1 discloses a controller that detects movement of a player's head and controls musical sound parameters on the basis of the detected movement of the head.

CITATION LIST

Patent Literature

[Patent Literature 1]
Japanese Patent Laid-Open No. H3-288897

SUMMARY OF INVENTION

Technical Problem

With the controller described in Patent Literature 1, it is possible to adjust musical sound parameters while carrying out performance using both hands. However, with such a technique, since the movement of the head is used, a quick operation cannot be performed.

On the other hand, decreasing the size of the controller so that it can be worn on a fingertip or the like can be considered. However, when the controller is worn on a fingertip, the controller has difficulty in being combined with a musical instrument (for example, a keyboard instrument) which is played with movement of fingertips. In a keyboard instrument, since a posture of a finger pressing a key can change at every moment, there is concern about change of each musical sound parameter for each emission of sound.

The present disclosure is made in consideration of the above-mentioned problems and an objective thereof is to provide a musical instrument controller that can accurately perform control of musical sound parameters.

Solution to Problem

A musical instrument controller according to the present disclosure is a device that transmits a control signal to a sound generation device that emits sound on the basis of a musical performance signal which is acquired from a musical performance device.

The sound generation device is a device that processes or generates sound on the basis of the musical performance signal transmitted from the musical performance device. The sound generation device may be a sound source or may be an effect adding device such as an effector.

The musical performance device is a device that outputs a signal (a musical performance signal) based on the musical performance operation to the sound generation device. When the sound generation device is a sound source, the musical performance signal may be a sound emission start signal or a sound emission stop signal. When a sound source is incorporated in the musical performance device and the sound generation device is an effector or the like, the musical performance signal may be a sound signal.

A musical instrument controller according to the present disclosure is a device that transmits a control signal to a sound generation device. A control signal is typically a signal for controlling a sound-emitting state such as a signal for designating pitch bend or expression.

In this way, the present disclosure can be applied to a system that performs a musical performance operation using a musical performance device and controls a sound-emitting state of musical sound using a controller.

A musical instrument controller according to the present disclosure includes:

a reception means that receives a sound emission start signal which is transmitted on the basis of a musical performance operation from a musical performance device; a sensor that detects an amount of displacement from a reference position; and a control means that generates a control signal on the basis of the amount of displacement from the reference position and transmits the control signal to a sound generation device. The control means sets the reference position on the basis of the sound emission start signal which is received from the musical performance device.

The sensor is a sensor that detects an amount of displacement from a reference position. The sensor is not particularly limited as long as it can detect a displacement from a certain position. For example, the sensor may be an acceleration sensor or may be an angular velocity sensor or a distance sensor. The sensor may be provided separately from the controller.

The control means generates a control signal based on an amount of displacement from the reference position. For example, the control means generates a control signal for increasing the pitch of musical sound as the amount of displacement increases in a positive direction and decreasing the pitch of musical sound as the amount of displacement increases in a negative direction, and transmits the generated control signal to the sound generation device.

The control means in the present disclosure sets the reference position on the basis of the sound emission start signal which is transmitted form the musical performance device. When the sound emission start signal is transmitted, it means that a musical performance operation for emitting sound has been performed. Accordingly, by setting the reference position on the basis of the sound emission start signal at all times, it is possible to acquire an amount of displacement which is suitable for generating the control signal.

The control means may generate the control signal based on the amount of displacement from the reference position.

According to this embodiment, when the control signal for designating a value of a sound volume, pitch, or the like is used, it is possible to continuously designate a value corresponding to the amount of displacement The control means may generate the control signal when the amount of displacement from the reference position satisfies a predetermined condition.

By determining whether the amount of displacement has satisfied the predetermined condition, it is possible to detect a gesture which has been performed by a player. That is, it is possible to generate the control signal depending on a gesture. When the number of sensors is two or more, the condition determination using a plurality of amounts of displacement may be performed.

The reception means may further receive a sound emission stop signal which is transmitted on the basis of a musical performance operation. The control means may determine whether a transition from a sound-non-emitting state to a sound-emitting state has occurred on the basis of the sound emission start signal and the sound emission stop signal, and set the reference position when the transition has occurred.

The control means may determine whether the transition from the sound-emitting state to the sound-non-emitting state has occurred on the basis of the sound emission start signal and the sound emission stop signal, and initialize the reference position to a predetermined value when the transition has occurred.

With this configuration, the reference position is set at the time of emission of sound, and the reference position does not change until a next sound-non-emitting state. Accordingly, it is possible to provide a more stable control method.

The sensor may stop a sensing operation in a state in which a musical performance operation is not performed on the musical performance device.

Whether or not a musical performance operation is performed may be determined on the basis of a result of sensing or may be determined on the basis of information acquired from the musical performance device.

When a musical performance operation is not performed, transmission of sensor information is not advantageous. Accordingly, it is possible to curb power consumption by stopping the sensing operation. Stopping the sensing operation may include stopping supply of electric power to the sensor or may include stopping output of sensor data.

The sensor may be a triaxial acceleration sensor. The amount of displacement from the reference position may be a value indicating an amount of inclination from a predetermined posture.

An amount of inclination may be acquired using the triaxial acceleration sensor. Accordingly, it is possible to perform an intuitive operation by allowing a player to wear such a sensor on her or his body.

The amount of displacement may include a first amount of displacement corresponding to an inclination with a first direction as a rotation axis and a second amount of displacement corresponding to an inclination with a second direction perpendicular to the first direction as a rotation axis. The control means may generate a first control signal on the basis of the first amount of displacement and generate a second control signal on the basis of the second amount of displacement.

Each rotation axis may correspond to one of a pitch direction, a roll direction, and a yaw direction. For example, a first parameter can be changed by inclining the sensor in the pitch direction and a second parameter can be changed by inclining the sensor in the roll direction.

The first control signal and the second control signal may be signals for controlling a sound-emitting state.

For example, the first and second control signals may be signals for designating a sound volume, pitch, and fluctuation The first control signal may be a signal for designating expression, and the second control signal may be a signal for designating pitch bend.

By enabling such control to be performed according to the amount of inclination of the sensor, it is possible to perform enriched expression.

The control means may generate the control signal having a predetermined value when the amount of displacement from the reference position is equal to or less than a threshold value.

The threshold value may decrease in the case that an absolute value of the amount of inclination when the reference position has been set increases.

When musical performance is performed with the sensor worn on the body of a player, musical sound parameters may change slightly due to movement required for the musical performance operation (for example, movement of a finger which presses down a key). Accordingly, in order to prevent this problem, it is preferable that a certain margin be provided. For example, when an amount of displacement is in a range of the margin, a control signal for designating a default value may be generated.

The range of the margin may be uniform or may be set to a range corresponding to an amount of inclination when the reference position has been set. For example, when the absolute value of the amount of inclination when the reference position has been set is greater than a predetermined value, it may be determined that an operation for more sensitive information is performed and the margin may be set to be smaller.

The musical performance device may be a musical performance device including keys, and the sensor may be a sensor which is worn on a finger.

By wearing the sensor on a finger which is used to operate a key, it is possible to perform a more sensitive operation.

The sound emission start signal may be a note-on signal, and the sound emission stop signal may be a note-off signal.

A note-on signal and a note-off signal in a MIDI message can be suitably used as the sound emission start signal and the sound emission stop signal.

An electronic musical instrument system according to the present disclosure includes a musical performance device and a controller. The musical performance device includes a transmission means that transmits a sound emission start signal to the controller on the basis of a musical performance operation. The controller includes: a sensor that detects an amount of displacement from a reference position; and a control means that generates a control signal on the basis of the amount of displacement from the reference position and transmits the control signal to a sound generation device. The control means sets the reference position on the basis of the sound emission start signal which is received from the musical performance device.

The present disclosure may be specified as a musical instrument controller or an electronic musical instrument system including at least a part of the above-mentioned means. The present disclosure may also be specified as a control method for the musical instrument controller or the electronic musical instrument system. The present disclosure may be specified as a program for performing the control method. The processes or means can be freely combined in embodiments as long as no technical conflict arises.

DESCRIPTION OF EMBODIMENTS

First Embodiment

An electronic musical instrument system according to this embodiment includes a sensor device 10 that transmits sensor data to a control device 20, the control device 20 that controls an electronic musical instrument 30, and the electronic musical instrument 30.

Figure 1:
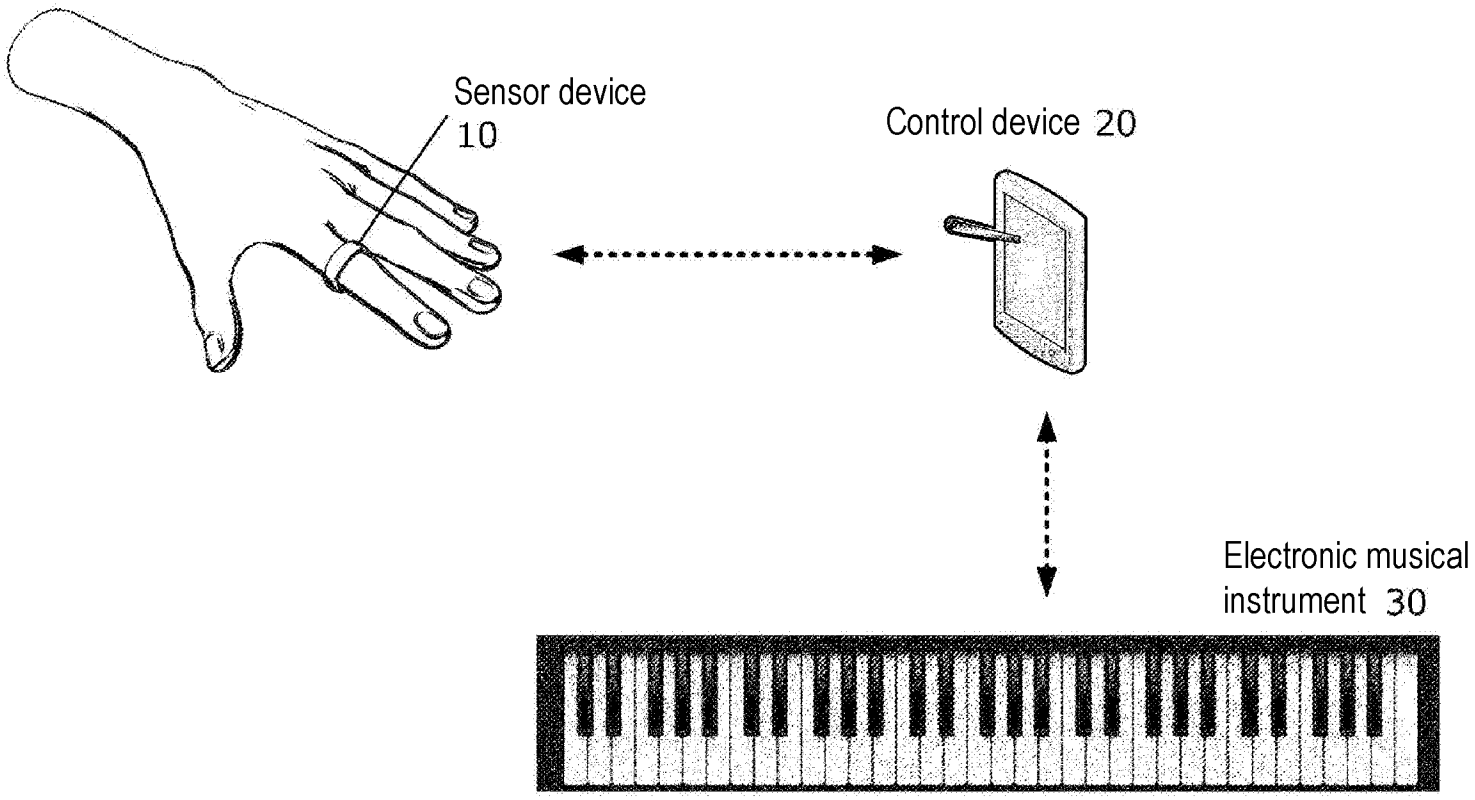
FIG. 1 is a diagram illustrating the overall configuration of an electronic musical instrument system.

FIG. 1 is a diagram illustrating a configuration of the electronic musical instrument system according to this embodiment.

The sensor device 10 is a ring-shaped sensor device that is worn by a player of the electronic musical instrument 30. Sensor data which is acquired by the sensor device 10 is transmitted to the control device 20. The control device 20 generates a control signal for controlling the electronic musical instrument 30 on the basis of the sensor data acquired from the sensor device 10 and transmits the generated control signal. Accordingly, it is possible to change parameters of musical sound which is output from the electronic musical instrument 30 or to add various effects to the musical sound. The sensor device 10, the control device 20, and the electronic musical instrument 30 are wirelessly connected to each other.

The electronic musical instrument 30 is a synthesizer including musical performance operators which are keys and a sound source. In this embodiment, the electronic musical instrument 30 generates musical sound corresponding to a musical performance operation which has been performed on the keys and outputs the musical sound from a speaker which is not illustrated. The electronic musical instrument 30 changes parameters of musical sound on the basis of a control signal which is transmitted from the control device 20.

Figure 2:
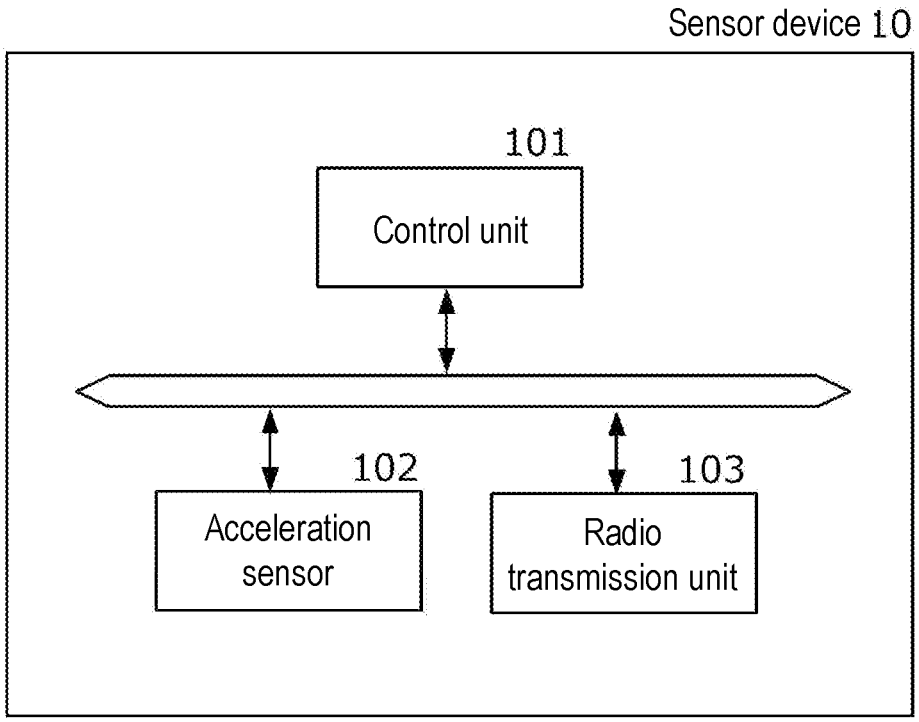
FIG. 2 is a diagram illustrating a hardware configuration of a sensor device 10.

First, the configuration of the sensor device 10 will be described. FIG. 2 is a diagram illustrating a hardware configuration of the sensor device 10.

The sensor device 10 is a sensor that detects an amount of displacement from a position serving as a reference (a reference position) by detecting a posture in a three-dimensional space. The sensor device 10 includes a control unit 101, an acceleration sensor 102, and a radio transmission unit 103. These means are driven with electric power which is supplied from a rechargeable battery (not illustrated).

In this embodiment, an object of which a posture is detected by the sensor device 10 is a person's finger.

The control unit 101 is an operational unit that takes charge of control which is performed by the sensor device 10. In this embodiment, the control unit 101 is configured as a one-chip microcomputer, in which a processing device that executes a program, a main storage device that is used to execute the program, an auxiliary storage device that stores the program, and the like are incorporated in the same hardware.

The acceleration sensor 102 is a triaxial acceleration sensor that can acquire acceleration ($m/s^2$) in three directions of an X axis, a Y axis, and a Z axis. Values which are output from the acceleration sensor 102 are acquired by the control unit 101. Three values acquired by the acceleration sensor 102 are referred to as sensor data.

In the following description, the X axis, the Y axis, and the Z axis represent axes with respect to the sensor device 10. Axes in a global coordinate system are referred to as an X' axis, a Y' axis, and a Z' axis.

Figure 3:
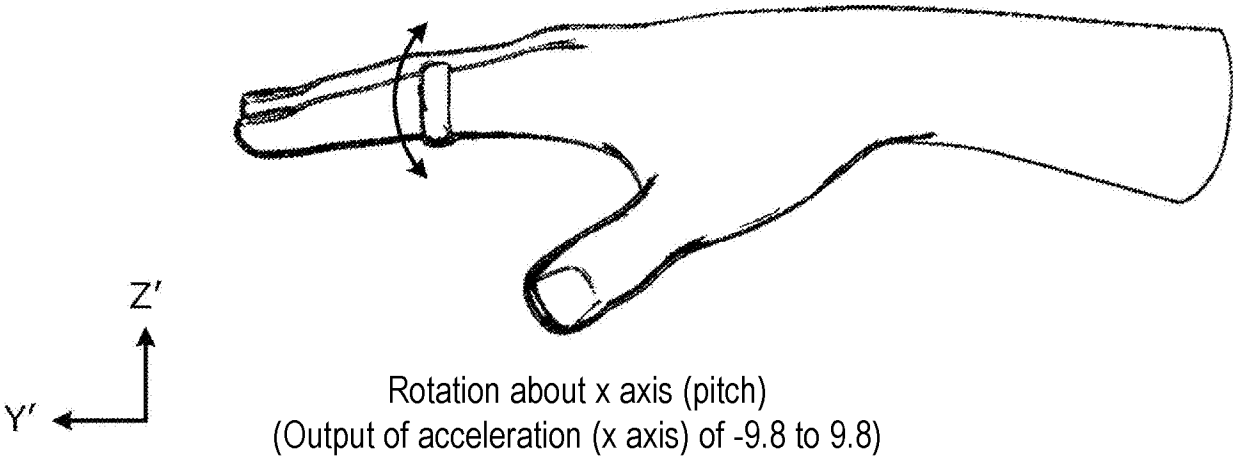
FIG. 3 is a diagram illustrating rotation of a detection object.
Figure 3:
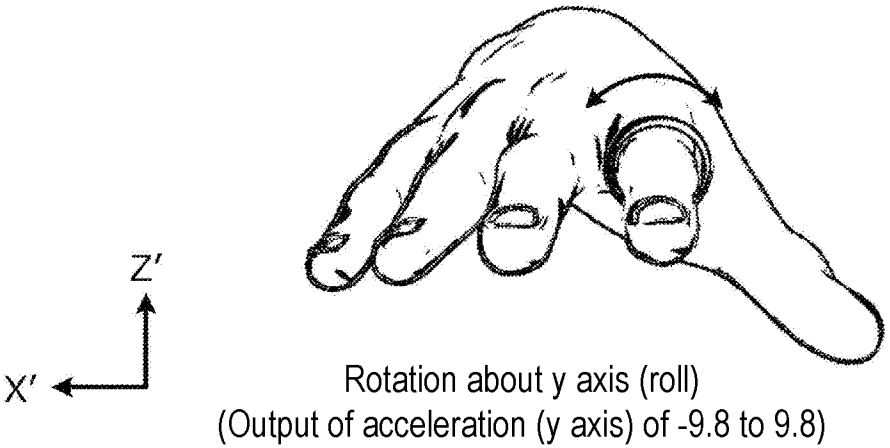

In this embodiment, a player of the electronic musical instrument 30 carries out performance while wearing the sensor device 10 on a finger. FIG. 3 is a diagram illustrating the sensor device 10 worn on a finger. In this embodiment, the control device 20 which will be described later detects an inclination with the X' axis as a rotation axis and an inclination with the Y' axis as a rotation axis on the basis of the sensor data output from the sensor device 10.

In the following description, the pitch direction represents an inclination direction with the X' axis as a rotation axis, and the roll direction represents an inclination direction with the Y' axis as a rotation axis.

In the state illustrated in FIG. 3, both the acceleration in the X-axis direction and the acceleration in the Y-axis direction are 0 [$m/s^2$]. When a hand rotates 90 degrees in the pitch direction in this state, the acceleration in the Y-axis direction is ±9.8 [$m/s^2$]. When the hand rotates 90 degrees in the roll direction, the acceleration in the X-axis direction is ±9.8 [$m/s^2$].

In this way, the control device 20 can recognize an inclination in the pitch direction and an inclination in the roll direction of the sensor device 10 by acquiring the acceleration in the X-axis direction and the acceleration in the Y-axis direction which are output from the sensor device 10.

The radio transmission unit 103 is a radio communication interface that wirelessly transmits a signal. In this embodiment, the radio transmission unit 103 transmits the values acquired by the acceleration sensor 102 (a measured value of the acceleration for each axis) to the control device 20.

In this embodiment, the radio transmission unit 103 performs data communication based on the Bluetooth (registered trademark) LowEnergy standard (hereinafter referred to as BLE). BLE is a low-energy communication standard using Bluetooth.

In this embodiment, BLE is exemplified, but another radio communication standard can also be used. For example, near field communication (NFC) or Wi-Fi (registered trademark) may be used. Another radio communication system (which includes an independent radio communication system) may be used.

The above-mentioned means are communicatively connected to each other by a bus.

The configuration illustrated in FIG. 2 is an example and some or all of the illustrated functions may be realized using a specially designed circuit. Storage and execution of a program may be performed by combination of the main storage device and the auxiliary storage device which are not illustrated.

Figure 4:
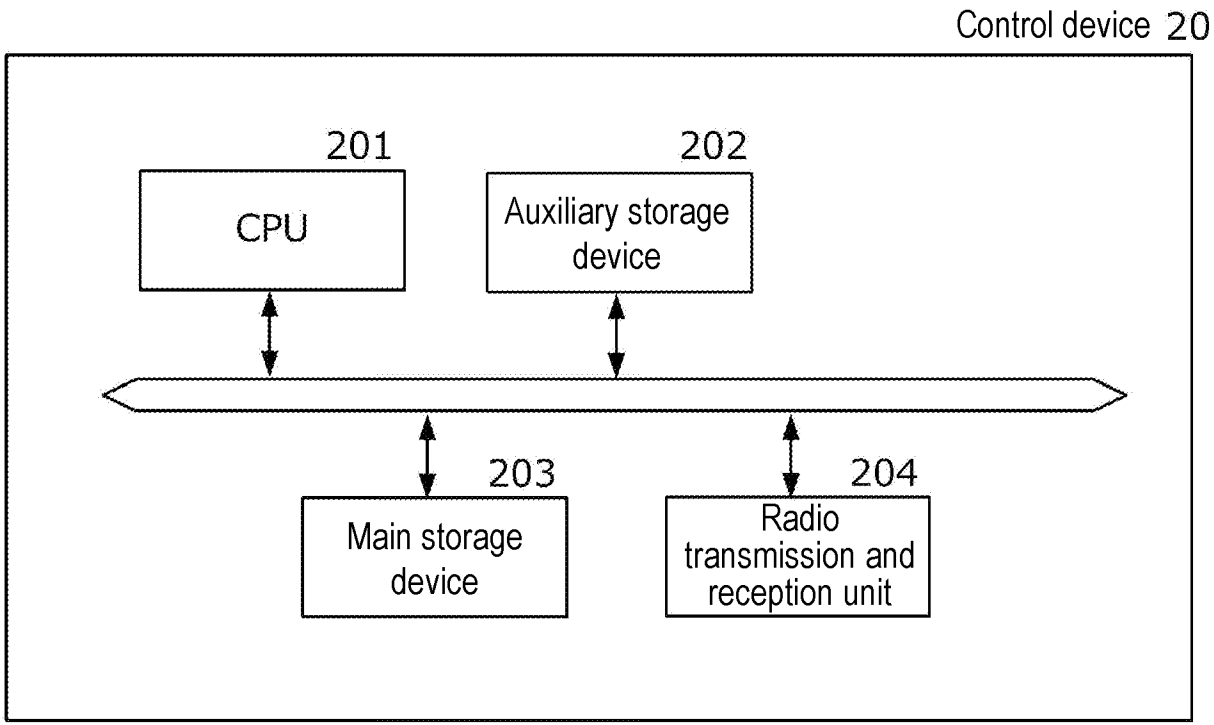
FIG. 4 is a diagram illustrating a hardware configuration of a control device 20.

The configuration of the control device 20 will be described below. FIG. 4 is a diagram illustrating the hardware configuration of the control device 20.

The control device 20 is a small-sized computer such as a smartphone, a mobile phone, a tablet computer, a personal digital assistant, a notebook computer, or a wearable computer (such as a smart watch). The control device 20 includes a central processing unit (CPU) 201, a ROM 202, a RAM 203, and a radio transmission and reception unit 204.

The CPU 201 is an operational unit that takes charge of control which is performed by the control device 20.

The auxiliary storage device 202 is a rewritable nonvolatile memory. A program which is executed by the CPU 201 and data which is used for the control program are stored in the auxiliary storage device 202. The auxiliary storage device 202 may store an application into which the program executed by the CPU 201 is packaged. The auxiliary storage device 202 may also store an operating system for executing such an application.

The main storage device 203 is a memory to which a program executed by the CPU 201 and data used for the control program are loaded. By loading a program stored in the auxiliary storage device 202 to the main storage device 203 and causing the CPU 201 to execute the program, the processes which will be described later are performed.

The radio transmission and reception unit 204 is a radio communication interface that transmits and receives signals to and from the sensor device 10 and the electronic musical instrument 30. In this embodiment, the radio transmission and reception unit 204 (1) acquires sensor data from the sensor device 10, (2) transmits a control signal which is generated on the basis of the sensor data to the electronic musical instrument 30, and (3) receives a note-on signal and a note-off signal from the electronic musical instrument 30. Details of the respective data will be described later.

The radio communication system may employ the above-mentioned BLE or another system. A system which is used for communication with the sensor device 10 and a system which is used for communication with the electronic musical instrument 30 may be different from each other. When BLE is used for connection between the control device 20 and the electronic musical instrument 30, a MIDI over Bluetooth LowEnergy (BLE-MIDI) standard may be used.

The configuration illustrated in FIG. 4 is an example and some or all of the illustrated functions may be realized using a specially designed circuit. Storage and execution of a program may be performed by combination of the main storage device and the auxiliary storage device which are not illustrated.

The hardware configuration of the electronic musical instrument 30 will be described below with reference to FIG. 5.

The electronic musical instrument 30 is a device that synthesizes musical sound on the basis of an operation which is performed on the musical performance operator (the keys) and amplifies and outputs the synthesized musical sound. The electronic musical instrument 30 includes a radio transmission and reception unit 301, a CPU 302, a ROM 303, a RAM 304, a musical performance operator 305, a DSP 306, a D/A converter 307, an amplifier 308, and a speaker 309.

The radio transmission and reception unit 301 is a radio communication interface that transmits and receives signals to and from the control device 20. In this embodiment, the radio transmission and reception unit 301 is wirelessly connected to the radio transmission and reception unit 204 of the control device 20, and (1) receives a control signal which is generated on the basis of the result of sensing performed by the sensor device 10 from the control device 20 and (2) transmits a note-on signal and a note-off signal to the control device 20. Details of the respective data will be described later.

The CPU 302 is an operational unit that takes charge of control which is performed by the electronic musical instrument 30. Specifically, processes which are described in this specification, processes of synthesizing musical sound using the DSP 306 which will be described later on the basis of scanning or an operation performed on the musical performance operator 305, and the like are performed.

The ROM 303 is a rewritable nonvolatile memory. A control program which is executed by the CPU 302 and data which is used for the control program are stored in the ROM 303.

The RAM 304 is a memory to which a control program executed by the CPU 302 and data used for the control program are loaded. By loading a program stored in the ROM 303 to the main storage device 304 and causing the CPU 302 to execute the program, the processes which will be described later are performed.

Figure 5:
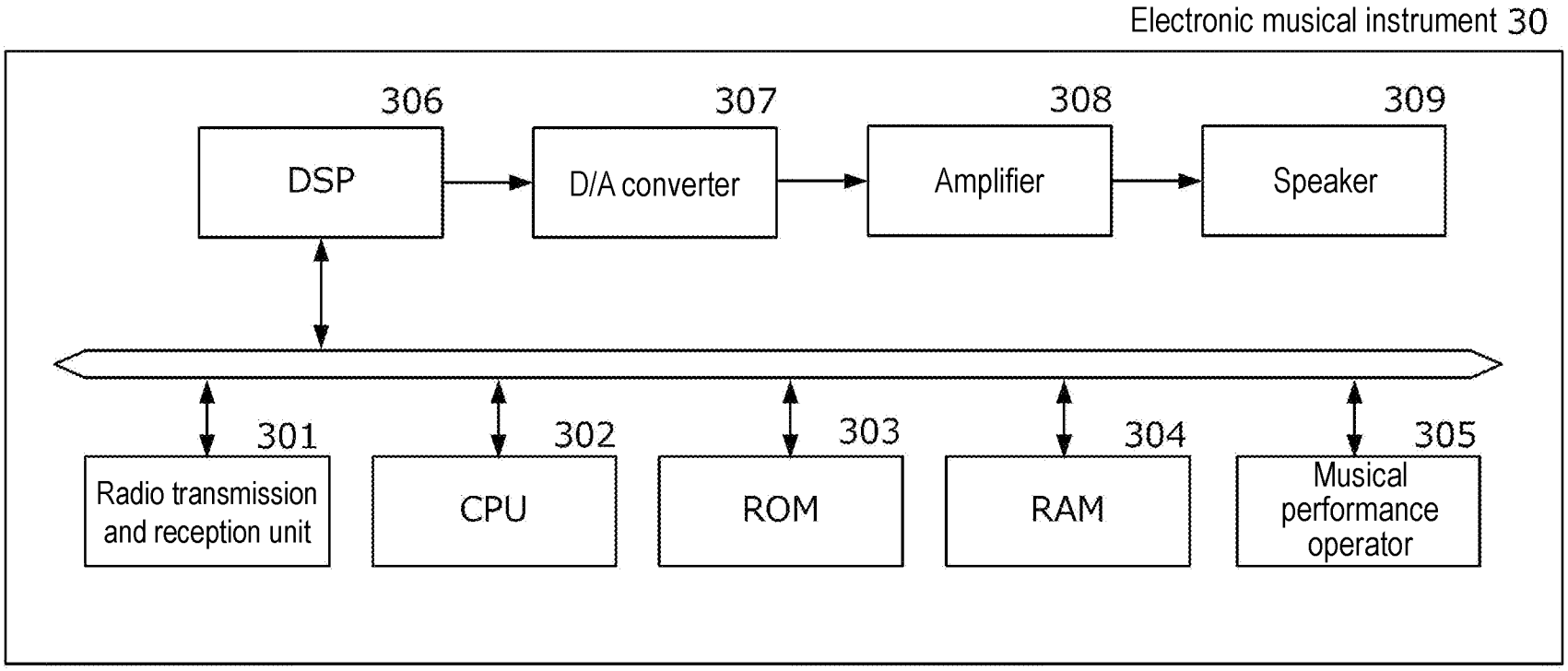
FIG. 5 is a diagram illustrating a hardware configuration of an electronic musical instrument 30.

The configuration illustrated in FIG. 5 is an example and some or all of the illustrated functions may be realized using a specially designed circuit. Storage and execution of a program may be performed by combination of the main storage device and the auxiliary storage device which are not illustrated.

The musical performance operator 305 is an interface that receives a musical performance operation of a player. In this embodiment, the musical performance operator 305 includes keys for carrying out performance and an input interface for designating musical sound parameters or the like (for example, a knob or a push button).

The DSP 306 is a microprocessor which is specialized for digital signal processing. In this embodiment, the DSP 306 performs a process specialized for processing a sound signal under the control of the CPU 302. Specifically, the DSP 306 performs synthesis of musical sound, adding an effect to musical sound, and the like on the basis of the musical performance operation and outputs a sound signal. The sound signal output from the DSP 306 is converted to an analog signal by the D/A converter 307, amplified by the amplifier 308, and then output from the speaker 309.

Figure 6:
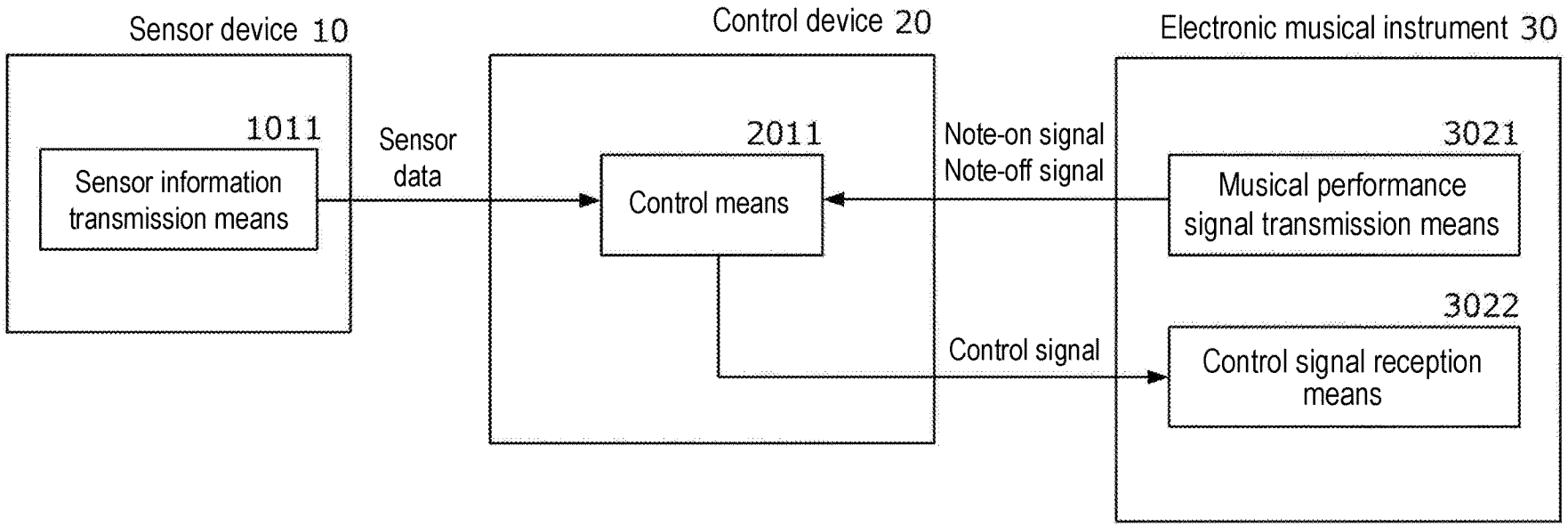
FIG. 6 is a diagram illustrating a module configuration of the electronic musical instrument system.

FIG. 6 is a diagram illustrating the configurations of the electronic musical instrument 30, the control device 20, and the sensor device 10 using functional modules.

A sensor information transmitting means 1011 transmits sensor data acquired by the acceleration sensor 102 to the control device 20. The sensor information transmitting means 1011 is realized by the control unit 101.

A control means 2011 acquire sensor data from the sensor device 10 and receives a note-on signal and a note-off signal from the electronic musical instrument 30. The control means 2011 generates a control signal on the basis of the sensor data acquired from the sensor device 10 and transmits the generated control signal to the electronic musical instrument 30. The control means 2011 is realized by the CPU 201.

A musical performance signal transmitting means 3021 transmits a note-on signal and a note-off signal to the control device 20 according to a musical performance operation.

A control signal reception means 3022 receives the control signal from the control device 20 and performs processing based on parameters which are included in the control signal.

The musical performance signal transmitting means 3021 and the control signal reception means 3022 are realized by the CPU 302.

The control means 2011 corresponds to a "control means" in the disclosure. The musical performance signal transmitting means 3021 corresponds to a "transmission means" in the disclosure. The sensor device 10 and the control device 20 correspond to a "controller" in the disclosure. The electronic musical instrument 30 corresponds to a "musical performance device" and a "sound generation device" in the disclosure.

Figure 7:
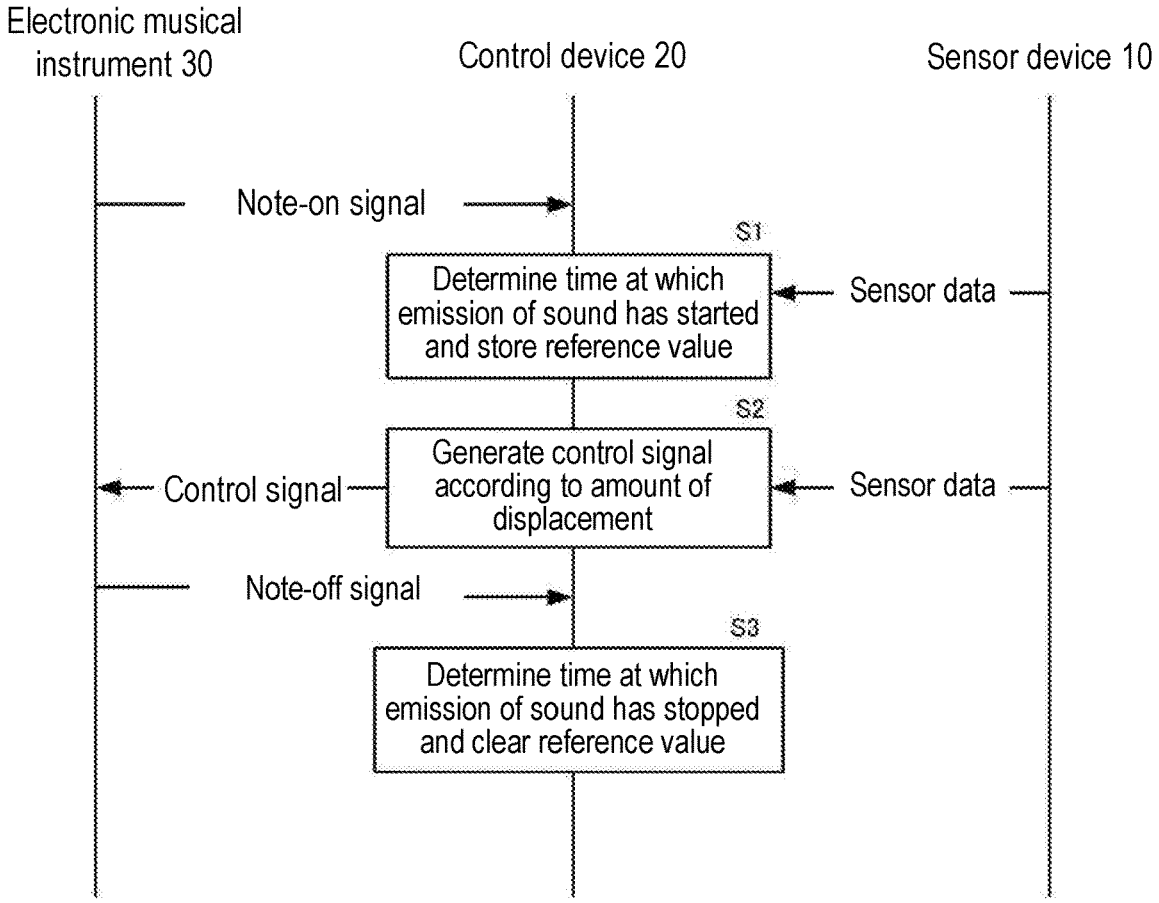
FIG. 7 is a diagram illustrating relations between elements of the system.

Outlines of the processes which are performed by the electronic musical instrument 30, the control device 20, and the sensor device 10 in this embodiment will be described. FIG. 7 is a diagram schematically illustrating data which is transmitted and received between the elements and processes.

In this embodiment, the electronic musical instrument 30 (the musical performance signal transmitting means 3021) transmits a note-on signal and a note-off signal to the control device 20 according to a musical performance operation, and the control device 20 (the control means 2011) detects that the electronic musical instrument 30 emits sound on the basis of the note-on signal and the note-off signal. The note-on signal is a signal indicating that a key has been pressed, and the note-off signal is a signal indicating that a finger has been removed from a key. In the field of electronic musical instruments, information indicating a channel, a note number, a velocity, or the like is generally added to the note-on signal and the note-off signal, but such information is not used in this embodiment.

The control device 20 (the control means 2011) acquires sensor data from the sensor device 10 (the sensor information transmitting means 1011) at a time at which emission of sound from the electronic musical instrument 30 has started, and stores a reference value on the basis of the sensor data (S1). In this embodiment, the reference value is a value indicating acceleration in the X-axis direction and acceleration in the Y-axis direction of the sensor device 10.

The step of determining the reference value corresponds to "setting of the reference position" in the disclosure.

Figure 8:
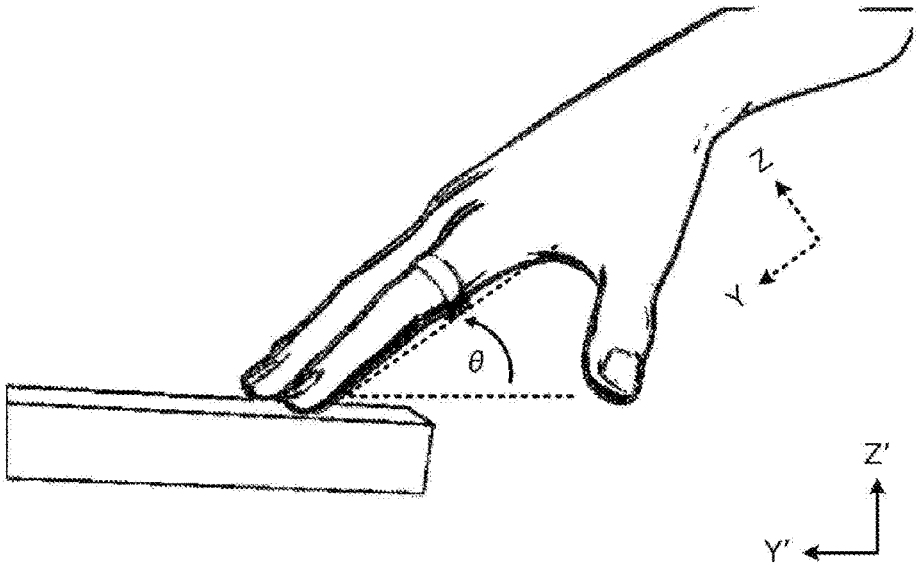
FIG. 8 is a diagram illustrating a reference value.

FIG. 8 is a diagram illustrating the posture of the sensor device 10 at a time at which a key is pressed. In this example, when θ (that is, a rotation angle in the pitch direction) is 30 degrees, the acceleration in the Y-axis direction is $\cos 30° \times 9.8 \approx 1.5$ [m/s$^2$] (hereinafter, the unit of acceleration is omitted unless necessary). Accordingly, this value is stored as the reference value in the pitch direction. The reference value in the roll direction is stored in the same way.

When the reference value has been set, the control device 20 (the control means 2011) calculates an amount of displacement from the reference value on the basis of the sensor data acquired from the sensor device 10 (the sensor information transmitting means 1011), generates a control signal corresponding to the amount of displacement, and transmits the control signal to the electronic musical instrument 30 (the control signal reception means 3022) (S2).

For example, when the reference value in the pitch direction is +1.5 and the acceleration in the Y-axis direction indicated by the sensor data is +2.5, a control signal corresponding to a difference (+1.0) therebetween is generated and transmitted to the electronic musical instrument 30. When the reference value in the pitch direction is +1.5 and the acceleration in the Y-axis direction indicated by the sensor data is 0, a control signal corresponding to a difference (−1.5) therebetween is generated and transmitted to the electronic musical instrument 30.

In this embodiment, a signal for designating expression and a signal for designating pitch bend are generated as the control signal. The signal for designating expression corresponds to the inclination in the pitch direction and the signal for designating pitch bend corresponds to the inclination in the roll direction. Accordingly, control of musical sound based on a posture of a hand becomes possible.

The set reference position is cleared at a time at which the emission of sound from the electronic musical instrument 30 has stopped completely (S3). Whether the emission of sound from the electronic musical instrument 30 has stopped completely can be determined by counting a note-on signal and a note-off signal. For example, when the note-on signal has been transmitted three times and the note-off signal has been subsequently transmitted three times, it can be determined that the emission of sound has stopped. In this embodiment, in this way, the reference position is cleared at the time at which the emission of sound has stopped completely, and a new reference position is set at a time at which the emission of sound has started again. Accordingly, regardless of a posture of a hand of a player who plays the keyboard instrument, it is possible to appropriately change expression and pitch bend.

Process flows which are performed by the elements will be described below in detail.

Figure 9:
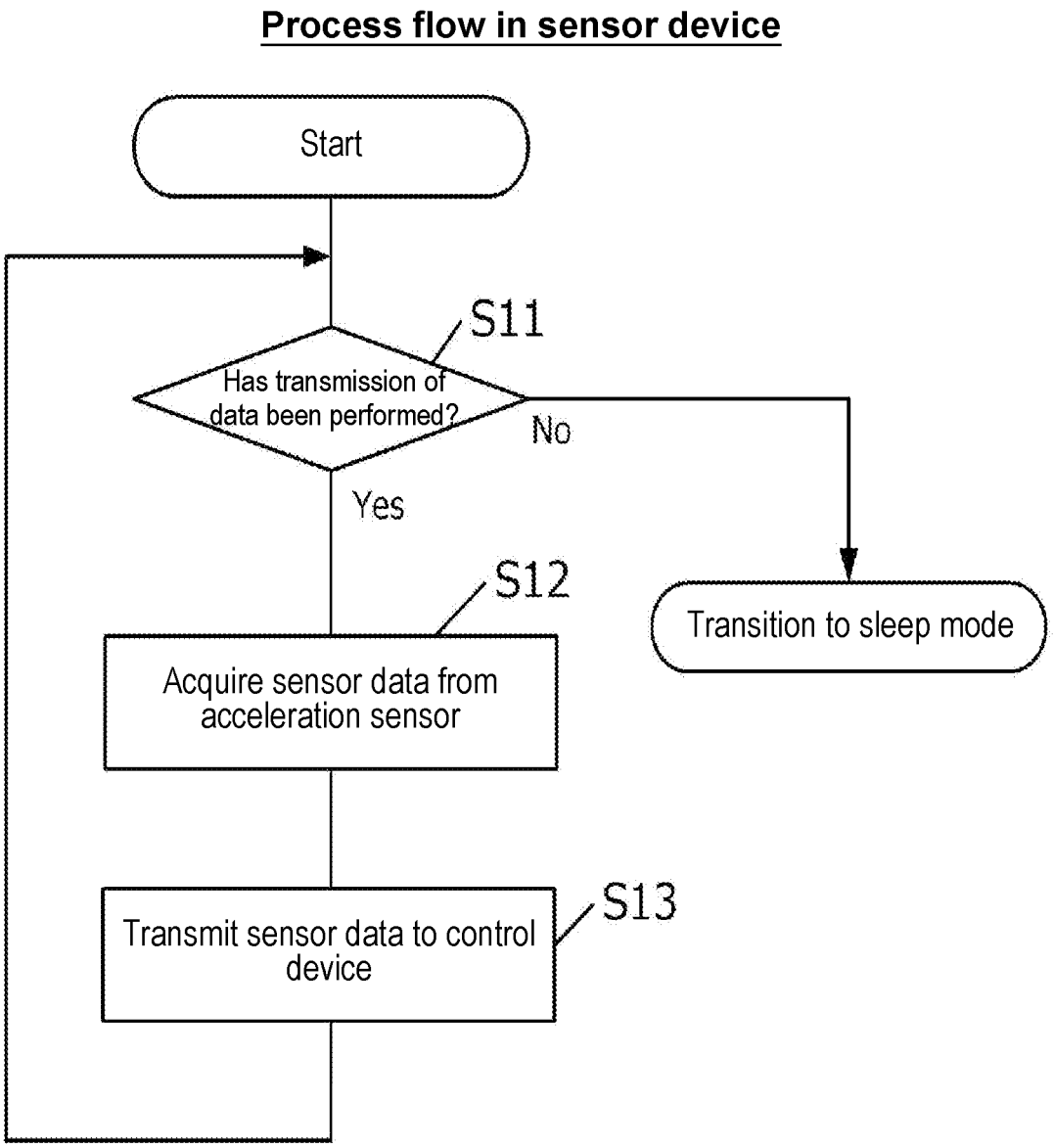
FIG. 9 is a flowchart illustrating a process flow which is performed by the sensor device 10.

FIG. 9 is a flowchart illustrating a process flow which is performed by the sensor device 10. The process flow illustrated in FIG. 9 is repeatedly performed by the control unit 101 (the sensor information transmitting means 1011) while the sensor device 10 is being powered on.

First, in Step S11, it is determined whether sensor data needs to be transmitted to the control device 20. For example, when the sensor device 10 is not used, it is not necessary to transmit the sensor data. Therefore, when it is determined that sensor data does not need to be transmitted, the control unit 101 causes the host device to transition to a sleep mode. In the sleep mode, the sensor device 10 stops the functions thereof other than minimal functions which are required for determining return from the sleep mode. When it has returned from the sleep mode, the process flow illustrated in FIG. 9 is restarted.

Whether or not the sensor device 10 is used can be determined, for example, by detecting that the sensor data acquired by the acceleration sensor (the acceleration of three axes) does not change in a predetermined period. Other conditions may be used.

In the sleep mode, a power supply of the acceleration sensor 102 may be turned off or only radio transmission of the sensor data may be stopped while acquisition of the sensor data continues. Only generation of transmission data may be stopped while radio transmission continues.

In Step S12, sensor data is acquired from the acceleration sensor 102. In Step S13, the acquired sensor data is transmitted to the control device 20 via the radio transmission unit 103.

The process flow which is performed by the control device 20 (the control means 2011) will be described below.

The process flow which is performed by the control device 20 is roughly classified into a process flow when a note-on signal and a note-off signal are received from the electronic musical instrument 30 and a process flow when sensor data is received from the sensor device 10. The process flow when a note-on signal and a note-off signal are received from the electronic musical instrument 30 will be first described below with reference to FIG. 10.

First, in Step S21, it is determined whether the number of notes which are currently emitted is equal to or greater than 1 on the basis of the received signal. When the number of notes which are currently emitted is equal to or greater than 1, it is determined in Step S22 whether the number of notes determined on the basis of the control signal which has been received immediately previously (hereinafter referred to as a previous number of notes) is 0. When the previous number of notes is equal to or greater than 1 (S22: NO), it means that emission of sound continues and thus a next cycle is awaited without performing any particular process.

When the determination result of Step S22 is positive, it means that emission of sound is newly started, and thus a reference value is generated on the basis of the newest sensor data and is stored in Step S23. Specifically, the acceleration in the Y-axis direction is stored as the reference value in the pitch direction and the acceleration in the X-axis direction is stored as the reference value in the roll direction.

When it is determined in Step S21 that the number of notes which are currently emitted is 0 (S21: NO), it is determined in Step S24 whether the previous number of notes is 0. When the previous number of notes is 0 (S24: YES), it means that a state in which sound is not emitted continues, and thus the next cycle is waited for without performing any particular process. When the previous number of notes is equal to or greater than 1 (S24: NO), it means that emission of sound has stopped, and thus the reference value (in both the pitch direction and the roll direction) is cleared (is initialized to a predetermined value) in Step S25.

Figure 11:
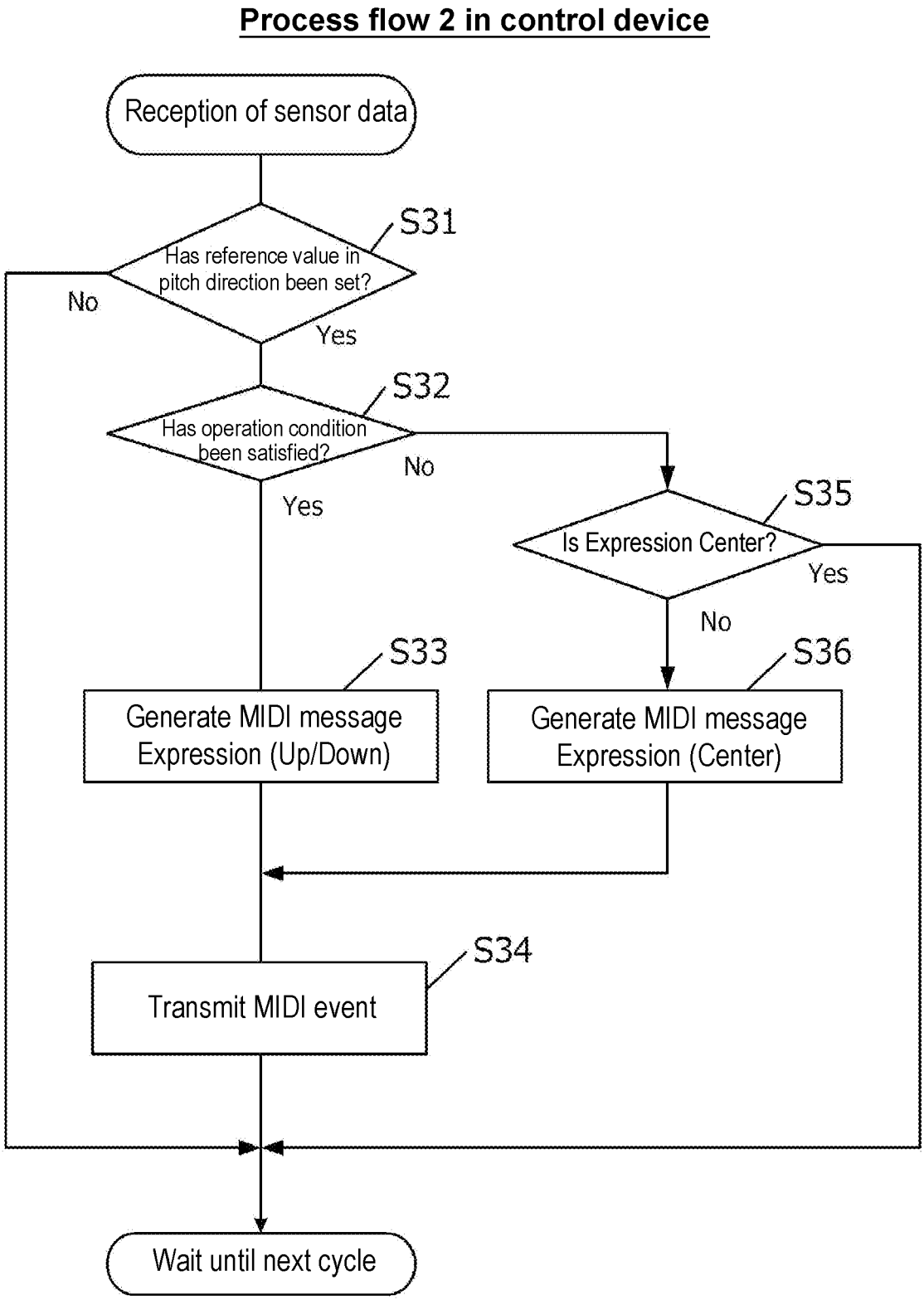
FIG. 11 is a flowchart (2) illustrating a process flow which is performed by the control device.
Figure 12:
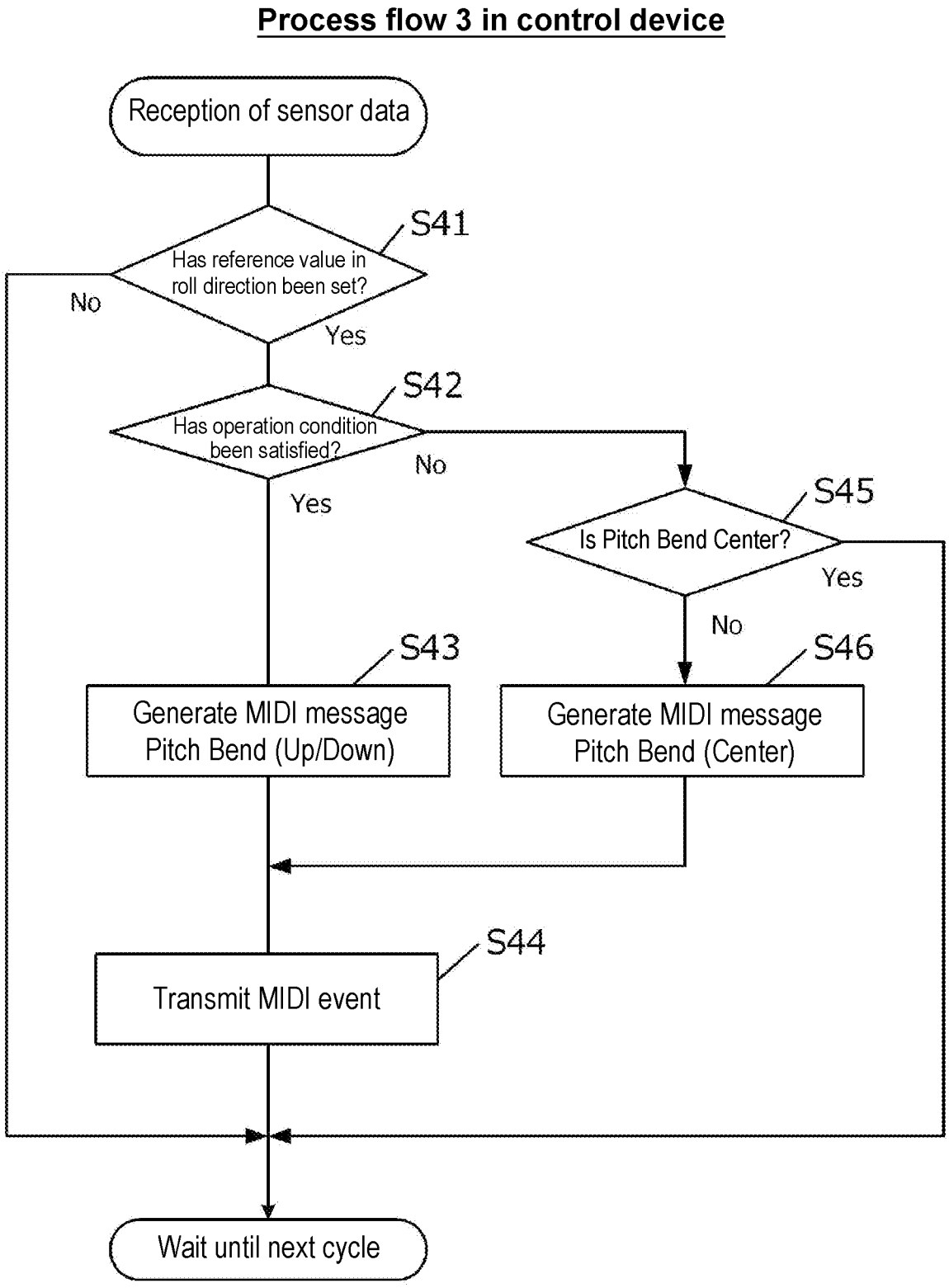
FIG. 12 is a flowchart (3) illustrating a process flow which is performed by the control device.

The process flow when the control device 20 (the control means 2011) receives sensor data from the sensor device 10 will be described below with reference to FIGS. 11 and 12. FIG. 11 is a diagram illustrating a process flow of transmitting a control signal to change an expression value, and FIG. 12 is a diagram illustrating a process flow of transmitting a control signal to change a pitch bend value. The process flows illustrated in FIGS. 11 and 12 are performed in parallel whenever sensor data is received from the sensor device 10.

The following description will be given with reference to FIG. 11.

First, in Step S31, it is determined whether the reference value in the pitch direction has been set. When the reference value in the pitch direction has not been set (which includes a case in which the reference value has been cleared), it means that the electronic musical instrument 30 has not emitted sound and thus the next cycle is waited for. When the reference value in the pitch direction has been set, it is determined in Step S32 whether an operating condition has been satisfied (whether a condition that an expression value has to be set has been satisfied).

Step S32 will be described below in detail.

In this embodiment, the acceleration acquired by the sensor device 10 is compared with preset acceleration (the reference value) and an expression value or a pitch bend value is set on the basis of an amount of displacement therebetween, but the expression value or the pitch bend value may change due to movement of a finger which performs a musical performance operation when this method is used.

Therefore, in Step S32, an amount of displacement is acquired by comparing current acceleration (the acceleration in the Y-axis direction) with the set reference value (the reference value in the pitch direction), it is determined whether the amount of displacement is within a range of a margin, and it is determined that the operating condition has not been satisfied (the condition that the expression value has to be set has not been satisfied) when the amount of displacement is not within the range of the margin.

The range of the margin has a value which varies according to the absolute value of the reference value.

Figure 13:
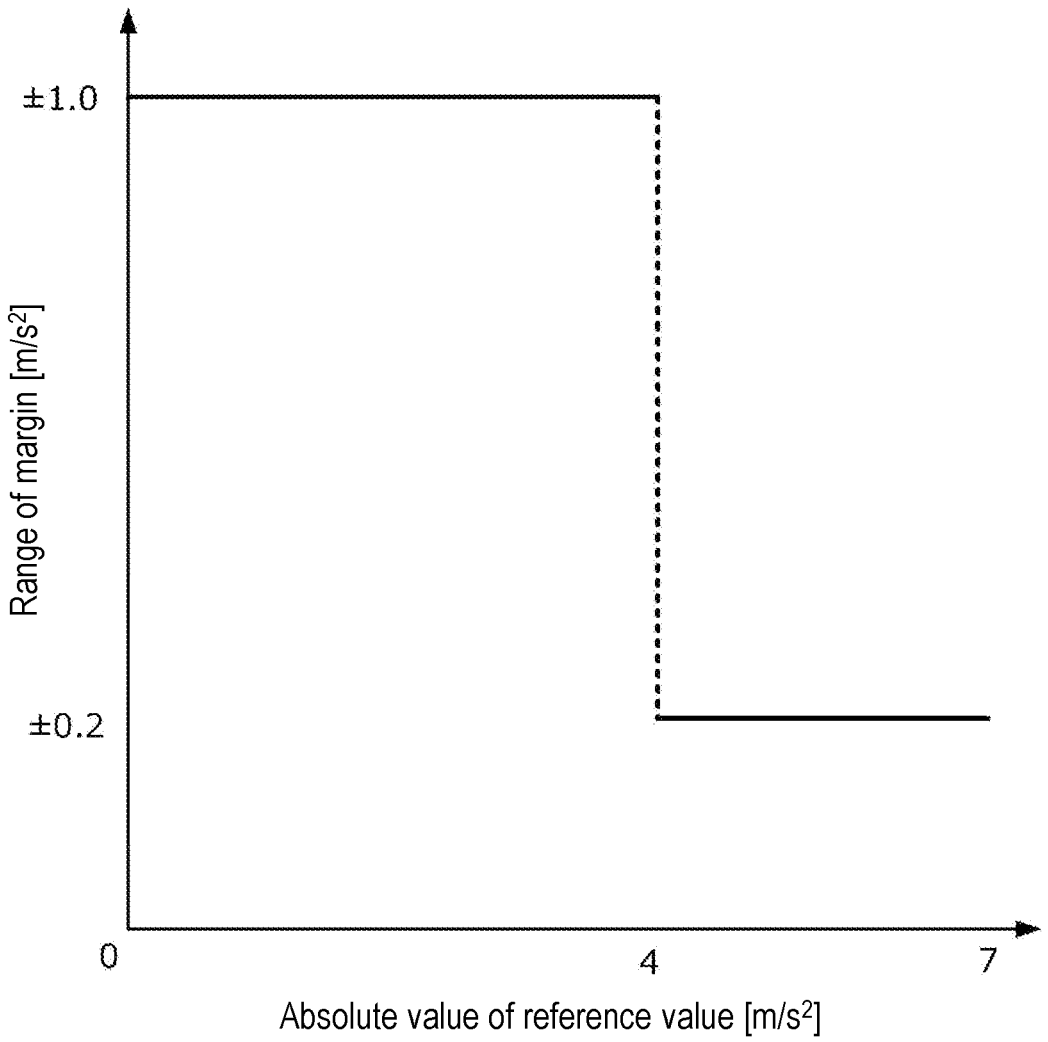
FIG. 13 is a diagram illustrating a margin setting criterion.

In the graph illustrated in FIG. 13, the horizontal axis represents the absolute value of the set reference value and the vertical axis represents the range of the margin. In this example, the range of the margin is set to "±1.0" when the absolute value of the set reference value is less than 4.0, and the range of the margin is set to "±0.2" when the absolute value of the set reference value is equal to or greater than 4.0 and less than 7.0.

For example, when the reference value in the pitch direction is +3.0, a range of +2.0 to +4.0 is the margin. In other words, when the current acceleration is in this range, the determination result of Step S32 is negative. When the reference value in the pitch direction is +5.0, a range of +4.8 to +5.2 is the margin. In this way, in this embodiment, control for decreasing the range of the margin as the reference value increases is performed. Accordingly, it is possible to switch between a more sensitive operation and a normal operation.

In this example, the range of the margin is set in two steps, but the range of the margin may be set in multiple steps or may change linearly.

Figure 14:
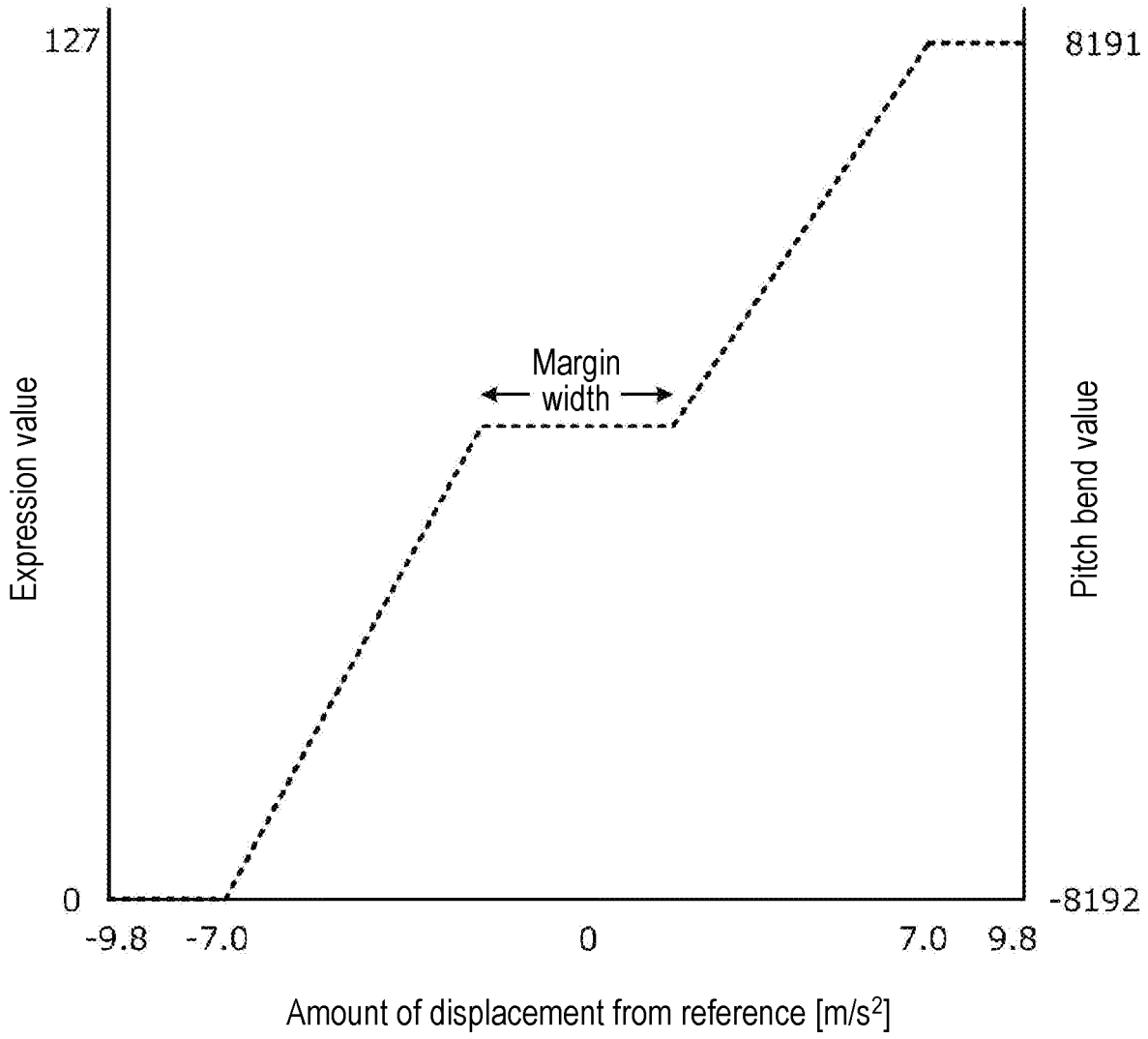
FIG. 14 is a diagram illustrating a relationship between an amount of displacement from the reference value and a control signal.

When the determination result of Step S32 is positive, a MIDI message is generated on the basis of the calculated amount of displacement. Specifically, as illustrated in FIG. 14, the expression value is determined on the basis of the amount of displacement from the reference value, and the MIDI message for designating the expression value is generated (Step S33). The generated message is transmitted to the electronic musical instrument 30 in Step S34.

When the determination result of Step S32 is negative, that is, when the acquired amount of displacement is within the range of the margin, it is determined whether the current expression value is a median value (for example, 64) (Step S35). When the current expression value is not a median value, a MIDI message for designating the median value is generated (Step S36). When the current expression value is already the median value, the process flow ends and the next cycle is awaited.

The same is true of the process flow illustrated in FIG. 12. The process flow illustrated in FIG. 12 is different from the process flow described above with reference to FIG. 11 in that the reference value in the roll direction is used in Step S41 and the reference value in the roll direction is compared with the acceleration in the X-axis direction in Step S42. In Step S43, the two process flows are different from each other in that a MIDI message for designating the pitch bend value (−8192 to 8191) is generated instead of the expression value (0 to 127). In Step S44, the MIDI message is transmitted.

When the determination result of Step S42 is negative, that is, when the acquired amount of displacement is within the range of the margin, it is determined whether the current pitch bend value is a median value (for example, 0) (Step S45). When the current pitch bend value is not the median value, a MIDI message for designating the median value is generated (Step S46). When the current pitch bend value is already the median value, the process flow ends and the next cycle is awaited.

The range of the margin may differ between the expression and the pitch bend.

According to the first embodiment, since a MIDI message for designating the expression value and the pitch bend value is generated according to an inclination angle of the sensor device 10, a player can control musical sound with natural movement. Since a reference value of acceleration is stored at the time at which emission of sound from the electronic musical instrument 30 has started and the same reference value is used until emission of sound stops, it is possible to perform natural control that does not depend on a performance method. By providing a margin for an amount of displacement of acceleration, it is possible to curb unnecessary variation of musical sound parameters.

Second Embodiment

In the first embodiment, in Step S11, the sensor device 10 detects that acceleration does not change and performs a transition to the sleep mode. On the other hand, a second embodiment is an embodiment in which the control device 20 determines whether emission of sound from the electronic musical instrument 30 has stopped and causes the sensor device 10 to the sleep mode on the basis of the result of determination.

Figure 10:
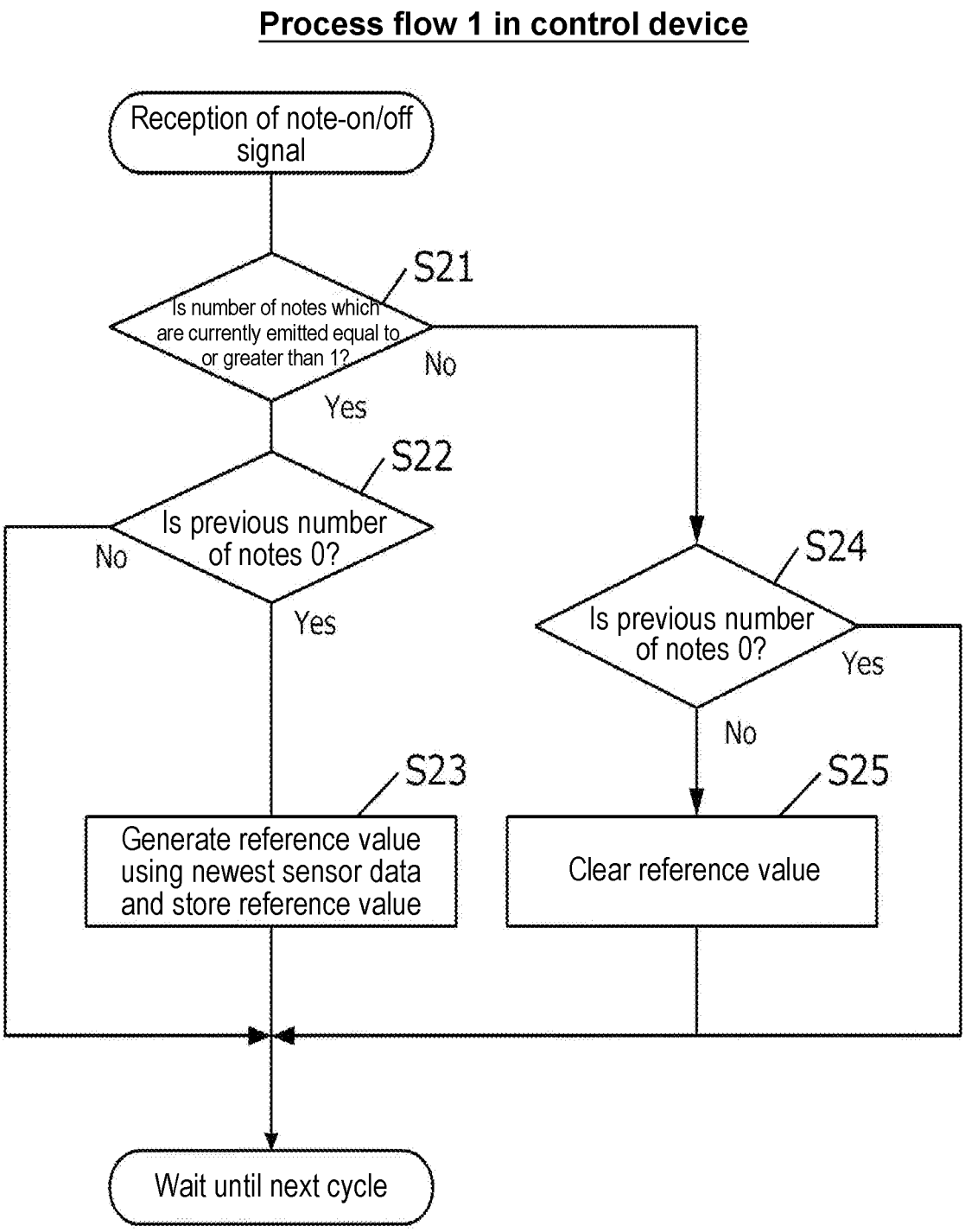
FIG. 10 is a flowchart (1) illustrating a process flow which is performed by the control device.

In the second embodiment, the control device 20 transmits a sleep signal to the sensor device 10 at the time of Step S25 illustrated in FIG. 10. When the sensor device 10 receives the sleep signal, the determination result of Step S11 is negative and the sensor device 10 transitions to the sleep mode. Accordingly, the functions of the sensor device 10 other than the functions required for determining return from sleep (wake-up) stop.

At the time at which the positive determination result of Step S22 has been acquired, the control device 20 transmits a wake-up signal to the sensor device 10. When the sensor device 10 receives the wake-up signal, the process flow illustrated in FIG. 9 is restarted. After the wake-up signal has been transmitted, it is preferable that the process flow wait until sensor data is received and progress to Step S23.

According to the second embodiment, it is possible to determine that sensor data does not need to be transmitted even when a player wears the sensor device 10 and to transition to a power save mode. That is, it is possible to achieve a greater effect of power save.

Third Embodiment

In the first and second embodiments, the sensor device 10 includes the acceleration sensor 102. On the other hand, a third embodiment is an embodiment in which the sensor device 10 further includes an angular velocity sensor and a geomagnetic sensor.

Figure 15:
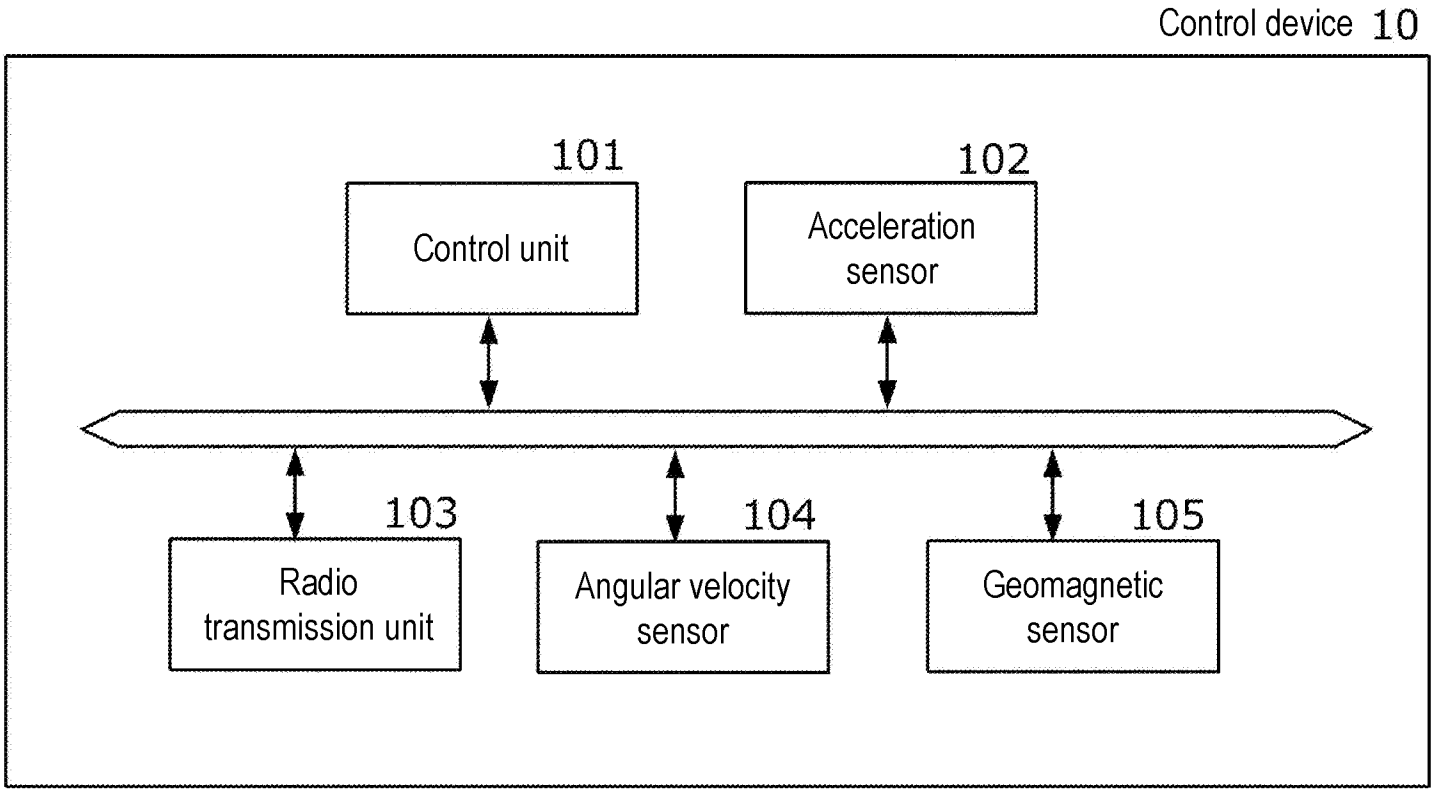
FIG. 15 is a diagram illustrating a hardware configuration of a sensor device according to a third embodiment.

FIG. 15 is a diagram illustrating a hardware configuration of the sensor device 10 according to the third embodiment. In the third embodiment, the sensor device 10 further includes an angular velocity sensor 104 and a geomagnetic sensor 105.

The angular velocity sensor 104 is a triaxial angular velocity sensor that can acquire an angular velocity (deg/s) with each of the X axis, the Y axis, and the Z axis (in the sensor coordinate system) as a rotation axis. Values which are output from the angular velocity sensor 104 are acquired by the control unit 101.

The geomagnetic sensor 105 is a triaxial geomagnetic sensor that can acquire a value of magnetic force in a direction corresponding to each of the X axis, the Y axis, and the Z axis (in the sensor coordinate system). Values which are output from the geomagnetic sensor 105 are acquired by the control unit 101.

In the third embodiment, one of the acceleration sensor 102, the angular velocity sensor 104, and the geomagnetic sensor 105 can be selected as a sensor which is used for control of the electronic musical instrument 30. This selection may be performed, for example, by switching a switch which is provided in the sensor device 10 or may be performed by rewriting parameters which are set in the control unit 101 through radio communication.

When the angular velocity sensor 104 is used, the control device 20 can acquire an amount of rotation of the sensor device 10 from a time at which integration has started by integrating the angular velocity which has been acquired every unit time. For example, the integration is started at the time at which the reference value is set in Step S1 and a control signal based on the integrated amount of rotation is generated in Step S2. In Step S3, the integration is stopped. Accordingly, the same advantageous effects as in the first embodiment can be achieved.

Setting of the time at which the integration is started is included in "setting of a reference position" in the disclosure.

When the geomagnetic sensor 105 is used, the control device 20 can acquire a posture in a three-dimensional space of the sensor device 10 on the basis of the detected direction of the magnetic north. In the first embodiment, the detected acceleration is used without any change, but when the geomagnetic sensor is used, the acceleration can be replaced with a magnetic force or an inclination angle.

Fourth Embodiment

A fourth embodiment is an embodiment in which a gesture is detected by combination of two or more of the acceleration sensor, the angular velocity sensor, and the geomagnetic sensor and a control signal for the electronic musical instrument 30 is generated on the basis of the result of detection. The hardware configuration of the sensor device 10 according to the fourth embodiment is the same as that of the third embodiment. In the fourth embodiment, a plurality of pieces of sensor data corresponding to a plurality of sensors are periodically transmitted to the control device 20 in Step S13.

In the fourth embodiment, a reference value is set for each sensor and for each axis in the process of setting the reference value (Step S23). For example, values of acceleration in the X-axis, Y-axis, and Z-axis directions output from the acceleration sensor and values of magnetic forces in the X-axis, Y-axis, and Z-axis directions output from the geomagnetic sensor are set as the reference values. Regarding the angular velocity sensor, an integration start time is determined instead of storing output values thereof.

In this way, in the fourth embodiment, a posture in a three-dimensional space of each sensor is acquired in Step S23. That is, the reference position in the present disclosure is set.

Figure 16:
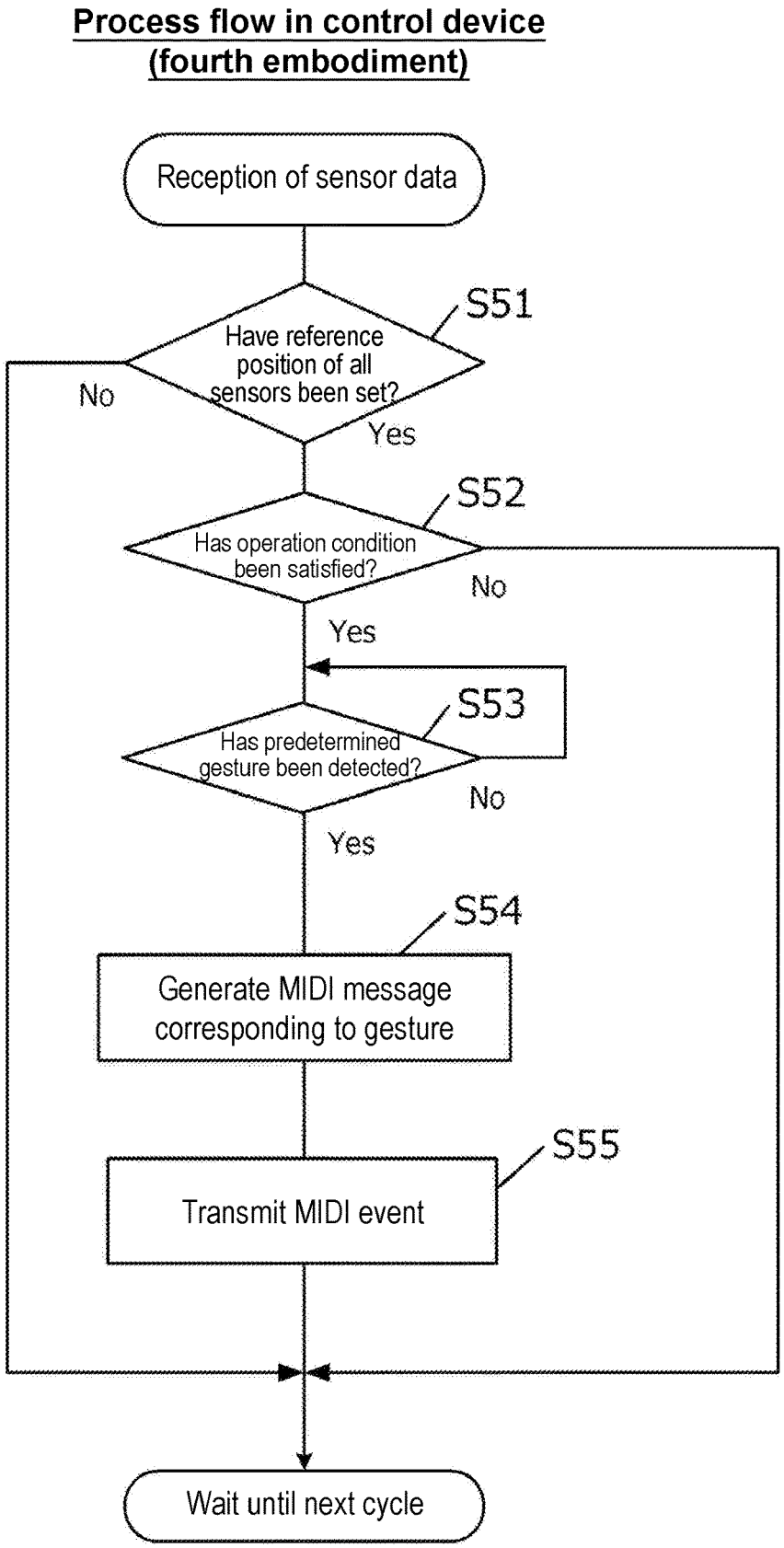
FIG. 16 is a flowchart illustrating a process flow according to a fourth embodiment.

In the fourth embodiment, the process flow illustrated in FIG. 16 is performed by the control device 20 (the control means 2011) instead of the process flows illustrated in FIGS. 11 and 12.

First, in Step S51, it is determined whether a reference position for each sensor has been set. Here, when the reference positions have not been set (which includes a case in which the reference positions are cleared), it means that the electronic musical instrument 30 has not emitted sound and thus the process flow waits for the next cycle. When the reference values for all the sensors have been set, it is determined in Step S52 whether an operating condition has been satisfied.

In Step S52, it is determined whether sensor data acquired from each sensor is in a range of a margin. The range of the margin can be appropriately set depending on the types of the sensors.

Then, in Step S53, it is determined whether a predetermined gesture has been taken with reference to a plurality of pieces of sensor data.

The gesture will be described below. Here, a motion including (1) rotating a right hand which is used for playing a keyboard instrument by 90 degrees to the right side with a forearm as an axis and (2) rotating a direction in which a finger is directed 90 degrees is assumed to be a predetermined gesture. For example, when a reference value is set in a state in which the sensor device 10 is worn on the right hand, the palm is tilted, and a fingertip faces a direction of 0 degrees (north) and when (1) a thumb faces upward and (2) the fingertip faces a direction of 90 degrees (east), it is determined that the predetermined gesture (a shaking gesture) has been made. The thumb facing upward can be detected by the acceleration sensor or the angular velocity sensor, and the fingertip facing the direction of 90 degrees can be detected by the geomagnetic sensor. In this way, what gesture has been made can be determined on the basis of the sensor data output from a plurality of sensors. In this step, whether conditions (values) which should be satisfied by a plurality of pieces of sensor data have been simultaneously satisfied may be determined, or whether the plurality of pieces of sensor data have been satisfied in predetermined order may be determined.

When it is determined that the predetermined gesture has been made, a MIDI message corresponding to the gesture is generated in Step S54 and is transmitted in Step S55. For example, a MIDI message of "setting an expression value to 0" can be allocated to the gesture. In this case, the sound volume becomes zero by making the gesture.

As described above, according to the fourth embodiment, a gesture can be detected using a plurality of sensors, and a control signal can be generated on the basis of the detected gesture and can be transmitted. In the first embodiment, a value is changed in real time on the basis of the value output from the sensor, but an arbitrary control signal can be allocated to an arbitrary gesture in this embodiment. A plurality of control signals can be allocated to a plurality of different gestures.

Modified Examples

The above embodiments are merely examples, and the present disclosure can be appropriately modified and embodied without departing from the gist thereof.

For example, in the above description of the embodiments, a synthesizer has been exemplified as the electronic musical instrument 30, but another musical instrument may be connected.

A musical instrument in which a musical performance operator and a sound source are separated from each other may be employed. In this case, a configuration in which a note-on signal or a note-off signal is received from a device including the musical performance operator and a control signal (a MIDI message) is transmitted to a device including the sound source may be employed.

A target device to which the control signal is to be transmitted may not be the device including the sound source. For example, the target device may be a device that adds an effect to input sound (an effector).

In the above description of the embodiments, the note-on signal and the note-off signal in the MIDI standard are used, but a message of another standard may be used as long as they are signals for notifying of sound emission start and sound emission stop.

In the above description of the embodiments, the sensor device 10 merely performs only transmission of sensor data and the control device 20 generates a control signal on the basis of the sensor data, but the present disclosure is not limited to the embodiments. For example, the functions of the sensor device 10 and the control device 20 may be collected in one piece of hardware and the piece of hardware may be worn on a player's hand.

In the above description of the embodiments, the sensor device 10 acquires a value indicating an inclination (acceleration in a predetermined axis direction) of the device, but the acquired information may be information indicating a parameter other than the inclination. For example, information indicating a relative position between a player or a musical instrument and a sensor or an absolute position of the sensor may be used. For example, a distance between a musical instrument and a sensor may be set as a reference value and a difference in distance may be used as an amount of displacement.

In the above description of the embodiments, expression and pitch bend have been exemplified as the musical sound parameters, but other musical sound parameters may be controlled as long as they can control a sound-emitting state. For example, a control signal for designating modulation, pan, or sustain may be generated.

The invention claimed is:

1. A musical instrument controller comprising:

a reception means that receives a sound emission start signal which is transmitted on the basis of a musical performance operation from a musical performance device;

a sensor that detects an amount of displacement from a reference position; and a control means that generates a control signal on the basis of the amount of displacement from the reference position and transmits the control signal to a sound generation device, wherein the control means sets the reference position on the basis of the sound emission start signal which is received from the musical performance device, wherein the sensor is a triaxial acceleration sensor, and wherein the amount of displacement from the reference position is a value indicating an amount of inclination from a predetermined posture.

2. The musical instrument controller according to claim 1, wherein the control means generates the control signal based on the amount of displacement from the reference position.

3. The musical instrument controller according to claim 1, wherein the control means generates the control signal when the amount of displacement from the reference position satisfies a predetermined condition.

4. The musical instrument controller according to claim 1, wherein the sound emission start signal is a note-on signal.

5. The musical instrument controller according to claim 1, wherein the reception means further receives a sound emission stop signal which is transmitted on the basis of a musical performance operation, and wherein the control means determines whether a transition from a sound-non-emitting state to a sound-emitting state has occurred on the basis of the sound emission start signal and the sound emission stop signal, and sets the reference position when the transition has occurred.

6. The musical instrument controller according to claim 5, wherein the control means determines whether the transition from the sound-emitting state to the sound-non-emitting state has occurred on the basis of the sound emission start signal and the sound emission stop signal, and initializes the reference position to a predetermined value when the transition has occurred.

7. The musical instrument controller according to claim 5, wherein the sound emission stop signal is a note-off signal.

8. The musical instrument controller according to claim 1, wherein the sensor stops a sensing operation in a state in which a musical performance operation is not performed on the musical performance device.

9. The musical instrument controller according to claim 1, wherein the amount of displacement includes a first amount of displacement corresponding to an inclination with a first direction as a rotation axis and a second amount of displacement corresponding to an inclination with a second direction perpendicular to the first direction as a rotation axis, and wherein the control means generates a first control signal on the basis of the first amount of displacement and generates a second control signal on the basis of the second amount of displacement.

10. The musical instrument controller according to claim 9, wherein the first control signal and the second control signal are signals for controlling a sound-emitting state.

11. The musical instrument controller according to claim 9, wherein the first control signal is a signal for designating expression, and wherein the second control signal is a signal for designating pitch bend.

12. The musical instrument controller according to claim 1, wherein the control means generates the control signal having a predetermined value when the amount of displacement from the reference position is equal to or less than a threshold value.

13. The musical instrument controller according to claim 12, wherein the threshold value decreases in a case where an absolute value of the amount of inclination increases when the reference position has been set.

14. The musical instrument controller according to claim 1, wherein the musical performance device is a musical performance device including keys, and wherein the sensor is a sensor which is worn on a finger.

15. An electronic musical instrument system comprising a musical performance device and a controller, wherein the musical performance device includes a transmission means that transmits a sound emission start signal to the controller on the basis of a musical performance operation, wherein the controller includes:

a sensor that detects an amount of displacement from a reference position; and a control means that generates a control signal on the basis of the amount of displacement from the reference position and transmits the control signal to a sound generation device, and wherein the control means sets the reference position on the basis of the sound emission start signal which is received from the musical performance device, wherein the sensor is a triaxial acceleration sensor, and wherein the amount of displacement from the reference position is a value indicating an amount of inclination from a predetermined posture.

16. A control method that is performed by a musical instrument controller which includes a sensor, the control method comprising:

a reception step of receiving a sound emission start signal which is transmitted on the basis of a musical performance operation from a musical performance device;

an acquisition step of acquiring information for detecting an amount of displacement from a reference position; and a control step of generating a control signal on the basis of the amount of displacement from the reference position and transmitting the control signal to a sound generation device, wherein the control step includes setting the reference position on the basis of the sound emission start signal which is received from the musical performance device, wherein the sensor is a triaxial acceleration sensor, and wherein the amount of displacement from the reference position is a value indicating an amount of inclination from a predetermined posture.

17. A control method that is performed by a musical performance device and a controller which includes a sensor, wherein the musical performance device performs a transmission step of transmitting a sound emission start signal to the controller on the basis of a musical performance operation, wherein the controller performs a control step of acquiring information for detecting an amount of displacement from a reference position, generating a control signal on the basis of the amount of displacement from the reference position, and transmitting the control signal to a sound generation device, and wherein the control step includes setting the reference position on the basis of the sound emission start signal which is received from the musical performance device, wherein the sensor is a triaxial acceleration sensor, and wherein the amount of displacement from the reference position is a value indicating an amount of inclination from a predetermined posture.

* * * * *